US009525270B2

(12) United States Patent
Matsunaga et al.

(10) Patent No.: US 9,525,270 B2
(45) Date of Patent: Dec. 20, 2016

(54) SPARK PLUG

(71) Applicant: NGK SPARK PLUG CO., LTD., Nagoya-shi, Aichi (JP)

(72) Inventors: Yuichi Matsunaga, Kounan (JP); Yasushi Sakakura, Ichinomiya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 14/896,506

(22) PCT Filed: Mar. 6, 2014

(86) PCT No.: PCT/JP2014/001246
§ 371 (c)(1),
(2) Date: Dec. 7, 2015

(87) PCT Pub. No.: WO2014/199540
PCT Pub. Date: Dec. 18, 2014

(65) Prior Publication Data

US 2016/0141840 A1 May 19, 2016

(30) Foreign Application Priority Data

Jun. 11, 2013 (JP) ..... 2013-122294

(51) Int. Cl.
*H01T 13/20* (2006.01)
*H01T 13/32* (2006.01)
(Continued)

(52) U.S. Cl.
CPC ..... *H01T 13/32* (2013.01); *H01T 13/39* (2013.01); *H01T 13/54* (2013.01)

(58) Field of Classification Search
CPC ..... H01T 13/32; H01T 13/20
(Continued)

(56) References Cited

U.S. PATENT DOCUMENTS

| | | | |
|---|---|---|---|
| 3,958,144 | A | 5/1976 | Franks |
| 6,064,144 | A | 5/2000 | Knoll et al. |
| 2002/0055318 | A1 | 5/2002 | Ishiguro et al. |

FOREIGN PATENT DOCUMENTS

| | | | |
|---|---|---|---|
| JP | 50-077738 | A | 6/1975 |
| JP | 08-171976 | A | 7/1996 |
| JP | 2002-141154 | A | 5/2002 |

OTHER PUBLICATIONS

Search Report dated Jun. 3, 2014, issued by the International Searching Authority in counterpart International Application No. PCT/JP2014/001246 (PCT/ISA/210).

(Continued)

*Primary Examiner* — Vip Patel
(74) *Attorney, Agent, or Firm* — Sughrue Mion, PLLC

(57) ABSTRACT

A spark plug (1) includes an insulator (2) having an axial hole (4), a center electrode (5) inserted into the axial hole (4), a metallic shell (3) provided around the insulator (2), a ground electrode (27) whose base end portion is fixed to the metallic shell (3) and which has an annular portion (27A) formed at a forward end portion thereof, the center electrode (5) being disposed radially inward of the annular portion (27A), and an annular tip (32) which is joined to the inner circumference of the annular portion (27A) and which forms a spark discharge gap (28) between the center electrode (5) and the inner circumferential surface of the annular tip (32). Recesses (35) are provided on at least one of the inner and outer circumferences of the annular portion (27A).

6 Claims, 13 Drawing Sheets

(51) Int. Cl.
*H01T 13/39* (2006.01)
*H01T 13/54* (2006.01)

(58) Field of Classification Search
USPC ..... 313/141, 132
See application file for complete search history.

(56) References Cited

OTHER PUBLICATIONS

Written Opinion dated Jun. 3, 2014, issued by the International Searching Authority in counterpart International Application No. PCT/JP2014/001246 (PCT/ISA/237).

SPARK PLUG

CROSS REFERENCE TO RELATED APPLICATIONS

This is a National Stage of International Application No. PCT/JP2014/001246 filed Mar. 6, 2014, claiming priority based on Japanese Patent Application No. 2013-122294 filed Jun. 11, 2013, the contents of all of which are incorporated herein by reference in their entirety.

TECHNICAL FIELD

The present invention relates to a spark plug for use in an internal combustion engine or the like.

BACKGROUND ART

A spark plug is attached to an internal combustion engine (engine) or the like, and is used to ignite, for example, a fuel-air mixture within a combustion chamber. In general, such a spark plug includes an insulator having an axial hole extending in the axial direction; a center electrode inserted into a forward end portion of the axial hole; a metallic shell provided around the insulator; and a ground electrode fixed to a forward end portion of the metallic shell. A high voltage is applied to a gap formed between a distal end portion of the ground electrode and a forward end portion of the center electrode. As a result, spark discharge occurs, whereby the fuel-air mixture or the like is ignited.

Incidentally, when the size of the above-mentioned gap increases as a result of corrosion of the center electrode and the ground electrode caused by the spark discharge or the like, the voltage (discharge voltage) necessary for generating spark discharge increases.

When the discharge voltage becomes excessively large, generation of spark discharge becomes impossible (so-called misfire occurs).

One conceivable method of preventing a rapid increase in the gap to thereby extend the service life of the spark plug is providing an annular portion at a forward end portion of the ground electrode and forming the above-mentioned gap between an inner circumferential surface of the annular portion and an outer circumferential surface of the center electrode. Since this method realizes uniform corrosion of the entire circumference of the center electrode, a rapid increase in the above-mentioned gap can be prevented effectively. Also, in recent years, there has been proposed a technique of further extending the service life of the spark plug. According to the proposed technique, an annular tip formed of a metal (e.g., metal including iridium, platinum, or the like) which is excellent in corrosion resistance is joined to a part of the inner circumference of the annular portion, which part forms the above-mentioned gap in cooperation with the outer circumferential surface of the center electrode (see, for example, Patent Documents 1 and 2).

PRIOR ART DOCUMENTS

Patent Documents

Patent Document 1: Specification of U.S. Pat. No. 6,064,144

Patent Document 2: Official gazette of Japanese Patent Application Laid-Open (kokai) No. H8-171976

SUMMARY OF THE INVENTION

Problem to be Solved by the Invention

Incidentally, the ground electrode is formed of a metal containing nickel as a main component, and the coefficient of thermal expansion of the tip is generally rendered smaller than that of the ground electrode. Accordingly, under high temperature during use, whereas the annular portion thermally expands to a large degree in its radial and axial directions, the tip does not thermally expand to a large degree. Therefore, a large difference in stress may be produced between the tip and the annular portion. As a result, as shown in FIGS. 24A and 24B, there arises a possibility that the tip 32 separates from the annular portion 27A or the tip 32 cracks.

The present invention has been accomplished in view of the above circumstances, and an object of the invention is to provide a spark plug which can effectively reduce the difference in stress occurring between the tip and the annular portion, to thereby more reliably prevent separation and cracking of the tip.

Means for Solving the Problem

Configurations suitable for achieving the above object will next be described in itemized form. When needed, actions and effects peculiar to the configurations will be described additionally.

Configuration 1. A spark plug of the present configuration comprises:

a tubular insulator having an axial hole extending therethrough in the direction of an axial line;

a center electrode inserted into a forward end portion of the axial hole;

a tubular metallic shell provided around the insulator;

a ground electrode whose base end portion is fixed to the metallic shell and which has an annular portion formed at a forward end portion thereof, the center electrode being disposed radially inward of the annular portion; and an annular tip which is joined to an inner circumference of the annular portion and which forms a gap between the center electrode and an inner circumferential surface of the annular tip, wherein a recess is provided on at least one of the inner circumference and an outer circumference of the annular portion.

According to the above-described configuration 1, under high temperature, the annular portion thermally expands toward the recess (deforms to fill the recess). Accordingly, thermal expansion of the annular portion in its radial and axial directions can be restrained, whereby the amount of deformation of the inner circumference (i.e., a portion to which the tip is joined) of the annular portion can be decreased. As a result, the difference in stress occurring between the tip and the annular portion can be decreased effectively, whereby separation and cracking of the tip can be prevented more reliably.

Configuration 2. A spark plug of the present configuration is characterized in that, in configuration 1, the recess extends at least from a forward end surface of the annular portion to a rear end of the tip, or at least from a rear end surface of the annular portion to a forward end of the tip.

According to the above-described configuration 2, the recess extends in a direction intersecting with the circumferential direction of the annular portion, and is formed to correspond to (to be present over) a range which extends in the axial direction and within which the tip is present. Accordingly, under high temperature, a portion of the annular portion where the tip is located on the inner circumference thereof can be more reliably caused to thermally expand toward the recess. As a result, radial deformation (deformation in the radial direction) of the portion of the annular portion where the tip is located on the inner circumference thereof can be restrained more effectively, whereby the difference in stress occurring between the tip and the annular portion can be decreased more effectively. As a result, separation and cracking of the tip can be prevented even more reliably.

Configuration 3. A spark plug of the present configuration is characterized in that, in configuration 1 or 2, the recess penetrates the annular portion from the inner circumference to the outer circumference thereof.

According to the above-described configuration 3, the volume of the recess can be increased, and, under high temperature, the annular portion becomes more likely to thermally expand toward the recess. Accordingly, under high temperature, deformation of the annular portion in its radial and axial direction can be restrained more effectively. As a result, the difference in stress occurring between the tip and the annular portion can be decreased further, whereby separation and cracking of the tip can be prevented more effectively.

Configuration 4. A spark plug of the present configuration is characterized in that, in any of configurations 1 to 3, a plurality of the recesses are provided intermittently along a circumferential direction of the annular portion, and the tip is joined to the annular portion in a region between adjacent recesses.

Under high temperature, a portion of the annular portion located between adjacent recesses deforms along the circumferential direction to fill the recesses, and is less likely to deform in the radial direction. Namely, under high temperature, the inner diameter of the portion of the annular portion located between adjacent recesses is very unlikely to increase.

In view of this point, according to the above-described configuration 4, the tip is joined to the annular portion in the region between adjacent recesses. Namely, the tip is joined to a portion of the annular portion where its inner diameter is particularly less likely to increase. Accordingly, the difference in stress occurring between the tip and the annular portion can be decreased very effectively. As a result, the effect of preventing separation and cracking of the tip can be enhanced further.

Configuration 5. A spark plug of the present configuration is characterized in that, in configuration 4, the tip is joined to the annular portion in a centrally located sub-region among three sub-regions obtained by equally trisecting the region between the adjacent recesses along the circumferential direction.

As described above, under high temperature, a portion of the annular portion located between adjacent recesses deforms (extends) along the circumferential direction to fill the recesses. However, a portion of the annular portion located at the center between the recesses is very small in the amount of extension along the circumferential direction under high temperature, as compared with portions of the annular portion located adjacent to the recesses.

In view of this point, according to the above-described configuration 5, the tip is joined to the annular portion in a centrally located sub-region among three sub-regions obtained by equally trisecting the region between the adjacent recesses along the circumferential direction. Namely, the tip is joined to a portion of the annular portion where its deformation along the circumferential direction is particularly small. Accordingly, the difference in stress occurring between the tip and the annular portion can be decreased very effectively. As a result, the effect of preventing separation and cracking of the tip can be enhanced further.

MODES FOR CARRYING OUT THE INVENTION

Figure 1:
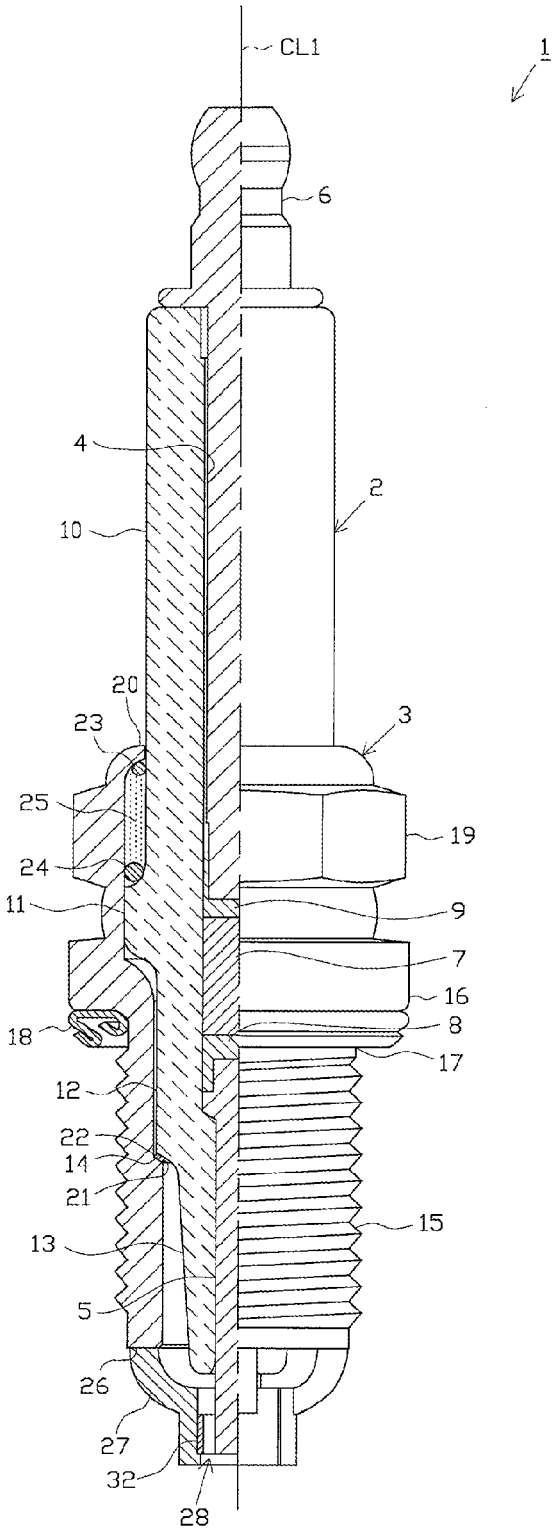
FIG. 1 is a partially cutaway front view showing the configuration of a spark plug.

One embodiment will now be described with reference to the drawings. FIG. 1 is a partially cutaway front view showing a spark plug 1. In FIG. 1, the direction of an axial line CL1 of the spark plug 1 is referred to as the vertical direction. In the following description, the lower side of the spark plug 1 in FIG. 1 is referred to as the forward end side of the spark plug 1, and the upper side as the rear end side.

The spark plug 1 includes a tubular ceramic insulator 2, which corresponds to the insulator in the present invention, and a tubular metallic shell 3, which holds the ceramic insulator 2 therein.

The ceramic insulator 2 is formed from alumina or the like by firing, as well known in the art. The ceramic insulator 2, as viewed externally, includes a rear trunk portion 10 formed at its rear end side; a large-diameter portion 11 located forward of the rear trunk portion 10 and protruding radially outward; an intermediate trunk portion 12 located forward of the large-diameter portion 11 and being smaller in diameter than the large-diameter portion 11; and a leg portion 13 located forward of the intermediate trunk portion 12 and being smaller in diameter than the intermediate trunk portion 12. In addition, the large-diameter portion 11, the intermediate trunk portion 12, and most of the leg portion 13 of the ceramic insulator 2 are accommodated within the metallic shell 3. A tapered, stepped portion 14 is formed at a connection portion between the intermediate trunk portion 12 and the leg portion 13. The ceramic insulator 2 is engaged with the metallic shell 3 at the stepped portion 14.

Further, the ceramic insulator 2 has an axial hole 4 extending therethrough along the axial line CL1. A center electrode 5 is fixedly inserted into a forward end portion of the axial hole 4. The center electrode 5 is formed of a metal containing nickel (Ni) as a main component, and assumes a rodlike (circular columnar) shape as a whole. A forward end portion of the center electrode 5 protrudes from the forward end of the ceramic insulator 2.

Additionally, an electrode terminal 6 is fixedly inserted into a rear end portion of the axial hole 4 in such a condition as to protrude from the rear end of the ceramic insulator 2.

Furthermore, a circular columnar resistor 7 is disposed within the axial hole 4 between the center electrode 5 and the electrode terminal 6.

The resistor 7 is electrically connected, at its opposite ends, to the center electrode 5 and the electrode terminal 6 through electrically conductive glass seal layers 8 and 9, respectively.

Additionally, the metallic shell 3 is formed into a tubular shape from a low-carbon steel or a like metal. The metallic shell 3 has, on its outer circumferential surface, a threaded portion (externally threaded portion) 15 adapted to mount the spark plug 1 to a combustion apparatus such as an internal combustion engine or a fuel cell reformer. Also, the metallic shell 3 has a seat portion 16 located rearward of the threaded portion 15 and protruding radially outward. A ring-shaped gasket 18 is fitted to a screw neck 17 at the rear end of the threaded portion 15. Furthermore, a tool engagement portion 19 having a hexagonal cross section and a crimped portion 20 bent radially inward are provided on the rear end side of the metallic shell 3. When the metallic shell 3 is mounted to the combustion apparatus, a tool such as a wrench is engaged with the tool engagement portion 19.

Also, the metallic shell 3 has, on its inner circumferential surface, a tapered, stepped portion 21 adapted to allow the ceramic insulator 2 to be engaged therewith. The ceramic insulator 2 is inserted forward into the metallic shell 3 from the rear end of the metallic shell 3. In a condition in which the stepped portion 14 of the ceramic insulator 2 is engaged with the stepped portion 21 of the metallic shell 3, a rear-end opening portion of the metallic shell 3 is crimped radially inward; i.e., the above-mentioned crimped portion 20 is formed, whereby the ceramic insulator 2 is fixed to the metallic shell 3. Notably, an annular sheet packing 22 intervenes between the stepped portions 14 and 21. This retains airtightness of a combustion chamber and prevents outward leakage of fuel gas entering a clearance between the leg portion 13 of the ceramic insulator 2 and the inner circumferential surface of the metallic shell 3, the clearance being exposed to the combustion chamber.

Furthermore, in order to ensure airtightness which is established by crimping, annular ring members 23 and 24 intervene between the metallic shell 3 and the ceramic insulator 2 in a region near the rear end of the metallic shell 3, and a space between the ring members 23 and 24 is filled with a powder of talc 25. That is, the metallic shell 3 holds the ceramic insulator 2 through the sheet packing 22, the ring members 23 and 24, and the talc 25.

Figure 2:
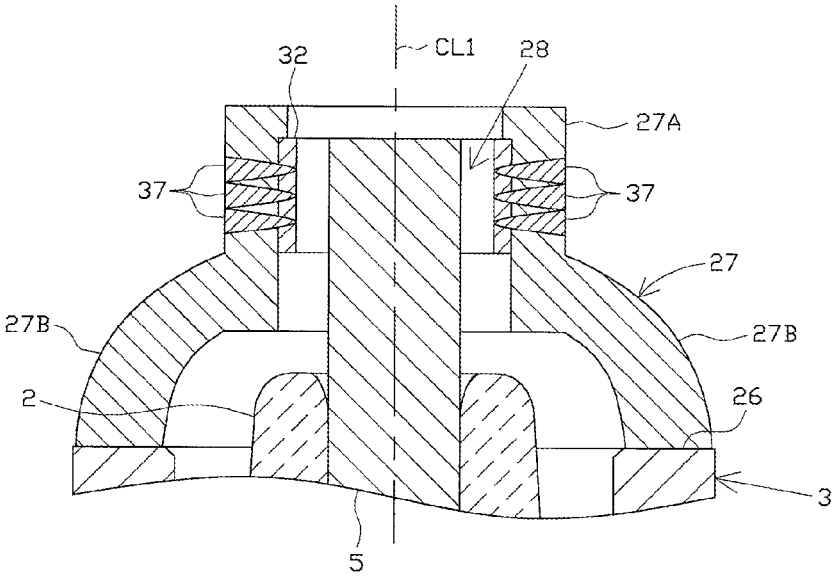
FIG. 2 is an enlarged sectional view showing the configuration of a forward end portion of the spark plug.

Also, as shown in FIG. 2, a ground electrode 27 formed of a predetermined metal (for example, a metal containing Ni as a main component) is joined to a forward end portion 26 of the metallic shell 3. The ground electrode 27 has an annular portion 27A and a plurality (in the present embodiment, four) of leg portions 27B. The annular portion 27A has an annular shape and its center coincides with the axial line CL1. A forward end portion of the center electrode 5 is disposed radially inward of the annular portion 27A. The leg portions 27B are provided on the outer circumference of a rear end portion of the annular portion 27A at equal intervals along the circumferential direction, and extend toward the rear end side.

In addition, an annular tip 32 formed of a predetermined metal (in the present embodiment, iridium (Ir) or a metal containing Ir as a main component) is joined to the inner circumference of the annular portion 27A. Notably, in the present embodiment, the coefficient of linear expansion of the metal constituting the ground electrode 27 (at least the annular portion 27A) is greater than that of the metal constituting the tip 32.

Also, a spark discharge gap 28, which corresponds to the gap in the claims, is formed between the entire inner circumferential surface of the tip 32 and the outer circumferential surface of the forward end portion of the center electrode 5. The spark discharge gap 28 has an annular shape, and its center coincides with the axial line CL1. In the spark discharge gap 28, spark discharge is produced generally along a direction orthogonal to the axial line CL1. Notably, in the present embodiment, since the spark discharge can be produced over the entirety of the inner circumferential surface of the tip 32, the tip 32 can be used more efficiently. As a result, the volume of corrosion of the tip 32 before causing misfire can be increased remarkably, whereby excellent durability can be realized.

Figure 3:
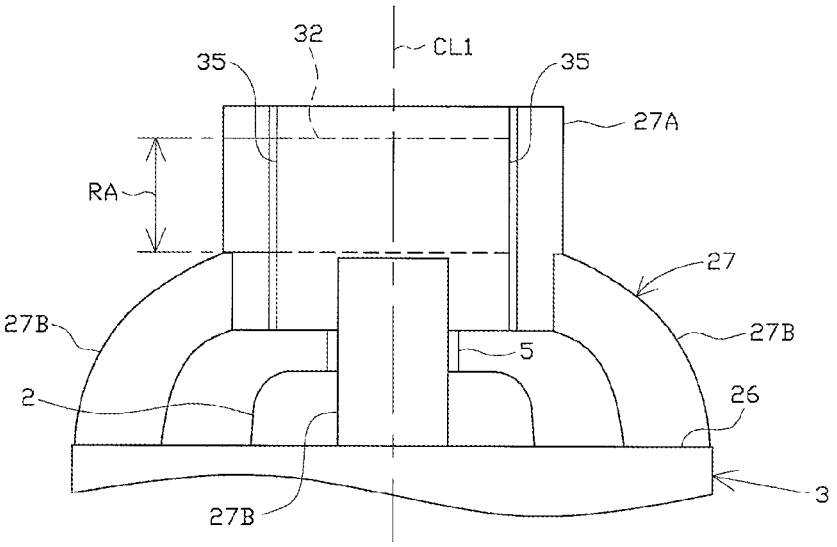
FIG. 3 is an enlarged front view showing the configuration of recesses, etc.
Figure 4:
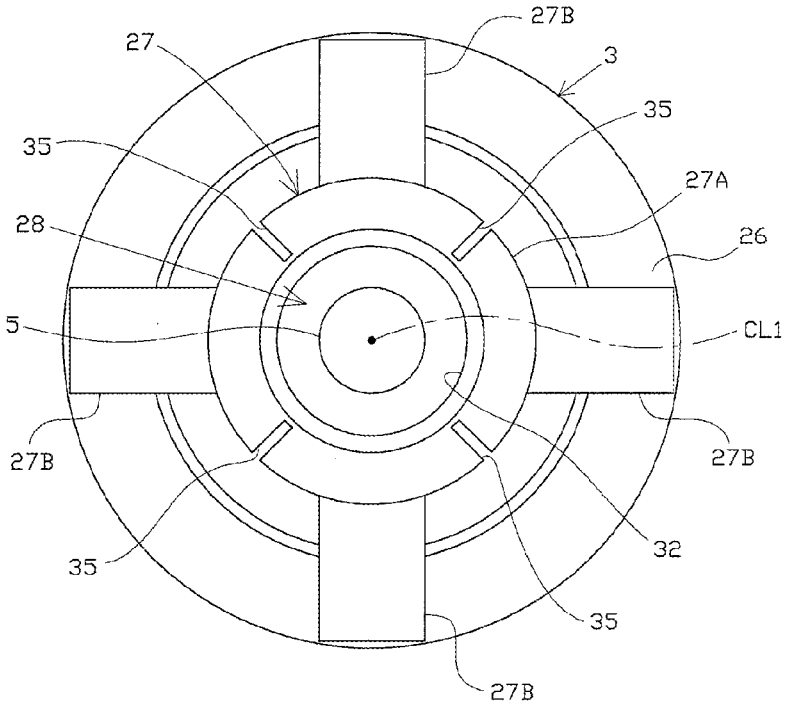
FIG. 4 is an enlarged bottom view showing the configuration of the recesses, etc.

Moreover, as shown in FIGS. 3 and 4, groove-shaped recesses 35 extending in a direction intersecting with the circumferential direction of the annular portion 27A (in the present embodiment, in the direction of the axial line CL1) are formed on at least one of the outer and inner circumferences of the annular portion 27A (in the present embodiment, on the outer circumference). A plurality (in the present embodiment, four) of the recesses 35 are provided at equal intervals along the circumferential direction of the annular portion 27A in such a manner that the recesses 35 are located at positions shifted, along the circumferential direction of the annular portion 27A, from the positions at which the leg portions 27B are connected to the annular portions 27A. Also, the recesses 35 are constituted to extend at least from the forward end surface of the annular portion 27A to the rear end of the tip 32, or at least from the rear end surface of the annular portion 27A to the forward end of the tip 32.

Namely, the recesses 35 are configured to extend over the entirety of a range RA which extends along the axial line CL1 and within which the tip 32 is present. In particular, in the present embodiment, the recesses 35 are constituted to penetrate the annular portion 27A from the rear end surface to the forward end surface thereof.

Figure 5:
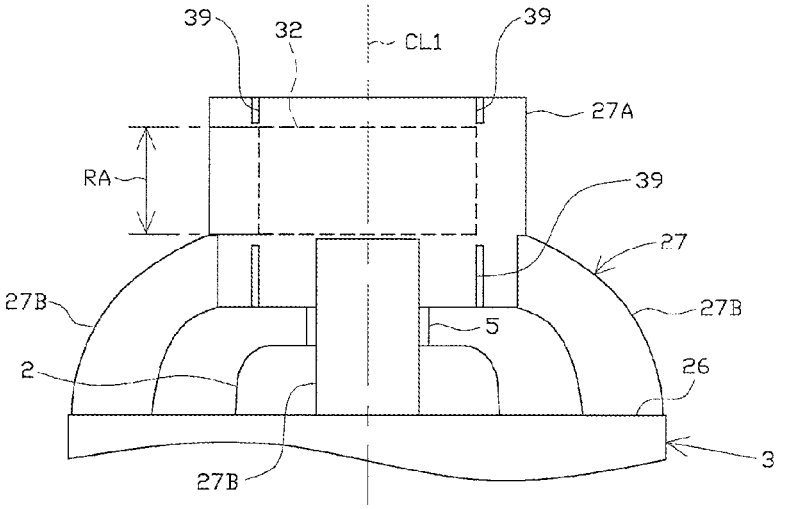
FIG. 5 is an enlarged front view showing another example of the recesses.
Figure 6:
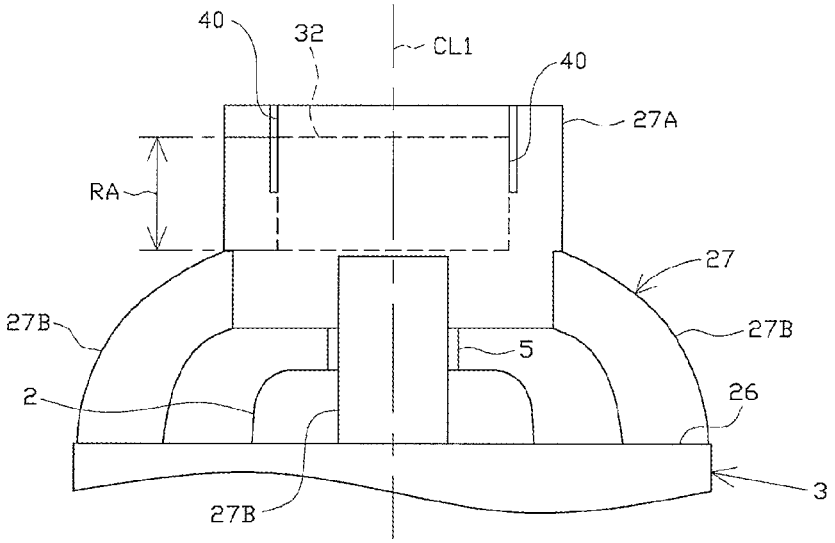
FIG. 6 is an enlarged front view showing another example of the recesses.

Notably, the recesses 35 are not necessarily required to extend over the entirety of the range RA which extends along the axial line CL1 and within which the tip 32 is present. For examples, as shown in FIG. 5, recesses 39 may be configured to exist at positions deviated from the range RA which extends along the axial line CL1 and within which the tip 32 is present. Alternatively, as shown in FIG. 6, recesses 40 may be configured to exist over a portion of the range RA which extends along the axial line CL1 and within which the tip 32 is present.

Also, in the present embodiment, the recesses 35 are grooves, and do not penetrate the annular portion 27A from the outer circumference to the inner circumference thereof. Therefore, the annular portion 27A is not split in the circumferential direction, and is a single portion.

Figure 7:
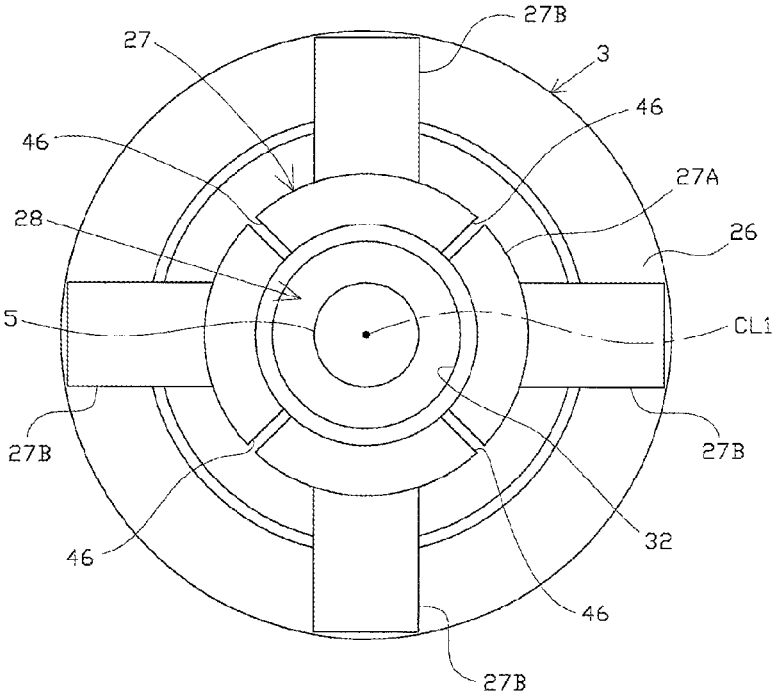
FIG. 7 is a bottom view showing another example of the recesses.

Notably, the recesses are not necessarily required to be grooves. For examples, as shown in FIG. 7, recesses 46 may be constituted to penetrate the annular portion 27A from the inner circumference to the outer circumference thereof.

Figure 8:
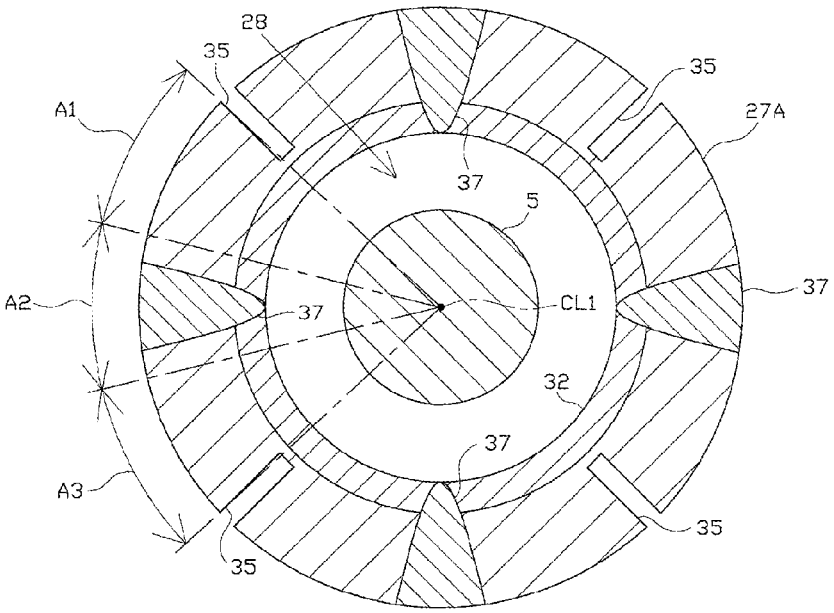
FIG. 8 is a sectional view showing positions at which a tip is joined to an annular portion.

In addition, as shown in FIGS. 2 and 8, the tip 32 is joined to the annular portion 27A through welds 37 which are formed as a result of irradiation of a laser beam or the like from the outer circumferential side of the annular portion 27A and where the tip 32 and the annular portion 27A have been fused, mixed, and solidified. A plurality of the welds 37 are provided continuously along the direction of the axial line CL1, and groups of the welds 37 provided continuously are provided at equal intervals along the circumferential direction.

Also, the tip 32 is joined to the annular portion 27A in regions each located between adjacent recesses 35. In particular, in the present embodiment, the region located between adjacent recesses 35 is equally trisected into three regions A1, A2, and A3 along the circumferential direction of the annular portion 27A, and the tip 32 is joined to the annular portion 27A in the region A2 located at the center.

In addition, in the present embodiment, the tip 32 is joined to the annular portion 27A in the centrally located region A2 only, and the tip 32 is not joined to the annular portion 27A in at least sub-regions of the regions A1 and A3 located on the side toward the recesses 35 (in the present embodiment, in the entireties of the regions A1 and A3). Notably, "at least sub-regions of the regions A1 and A3 located on the side toward the recesses 35" means sub-regions of the regions A1 and A3 each of which is one of three sub-regions obtained by equally trisecting the region A1 or A3 and each of which is located adjacent to the corresponding recess 35.

As having been described in detail, according to the present embodiment, the annular portion 27A thermally expands toward the recesses 35 (deforms to fill the recesses 35) under high temperature.

Accordingly, thermal expansion of the annular portion 27A in the radial and axial directions can be restrained, whereby the amount of deformation of the inner circumference (i.e., a portion to which the tip 32 is joined) of the annular portion 27A can be decreased.

As a result, the difference in stress occurring between the tip 32 and the annular portion 27A can be decreased effectively, whereby separation and cracking of the tip 32 can be prevented more reliably.

Further, the recesses 35 extending in a direction intersecting with the circumferential direction of the annular portion 27A are formed to correspond to the range RA which extends in the direction of the axial line CL1 and within which the tip 32 is present. Accordingly, under high temperature, a portion of the annular portion 27A where the tip 32 is located on the inner circumference thereof can be more reliably caused to thermally expand toward the recesses 35. As a result, radial deformation (deformation in the radial direction) of the portion of the annular portion 27A where the tip 32 is located on the inner circumference thereof can be restrained more effectively, whereby the difference in stress occurring between the tip 32 and the annular portion 27A can be decreased more effectively. As a result, separation and cracking of the tip 32 can be prevented more reliably.

In addition, in the present embodiment, the tip 32 is joined to the annular portion 27A in regions each of which is located between adjacent recesses 35. Namely, the tip 32 is joined to a portion of the annular portion 27A where its inner diameter is particularly less likely to increase. Accordingly, the difference in stress occurring between the tip 32 and the annular portion 27A can be decreased very effectively. As a result, the effect of preventing separation and cracking of the tip 32 can be enhanced further.

Also, the tip 32 is joined to the annular portion 27A in the above-described region A2 located at the center. Namely, the tip 32 is joined to a portion of the annular portion 27A where its deformation along the circumferential direction is particularly small. Accordingly, the difference in stress occurring between the tip 32 and the annular portion 27A can be decreased very effectively. As a result, the effect of preventing separation and cracking of the tip 32 can be enhanced further.

Moreover, in the present embodiment, the tip 32 is not joined to the annular portion 27A in at least sub-regions of the above-described regions A1 and A3, which sub-regions are located on the side toward the recesses 35. Namely, the tip 32 is not joined to a portion of the annular portion 27A where its deformation along the circumferential direction is somewhat large. As a result, the difference in stress occurring between the tip 32 and the annular portion 27A can be decreased further, and separation and cracking of the tip 32 can be prevented even more reliably.

Also, in the present embodiment, the annular portion 27A is not split in the circumferential direction, and is a single portion. Therefore, joining of the tip 32 to the ground electrode 27 (the annular portion 27A) can be performed easily, whereby productivity can be enhanced.

Notably, in the case where the recesses 46 penetrate the annular portion 27A from the inner circumference to the outer circumference thereof, the annular portion 27A thermally expands more easily toward the recesses 46 under high temperature. Accordingly, deformation of the annular portion 27A in the radial and axial direction can be restrained more effectively. As a result, the difference in stress occurring between the annular portion 27A and the tip 32 can be decreased further, and separation and cracking of the tip 32 can be prevented more effectively.

In addition, since the recesses 35 are provided on the outer circumference of the annular portion 27A, it is possible to secure a larger joint area between the tip 32 and the inner circumferential surface of the annular portion 27A. As a result, the joint strength of the tip 32 to the ground electrode 27 (the annular portion 27A) can be increased sufficiently.

Figure 9:
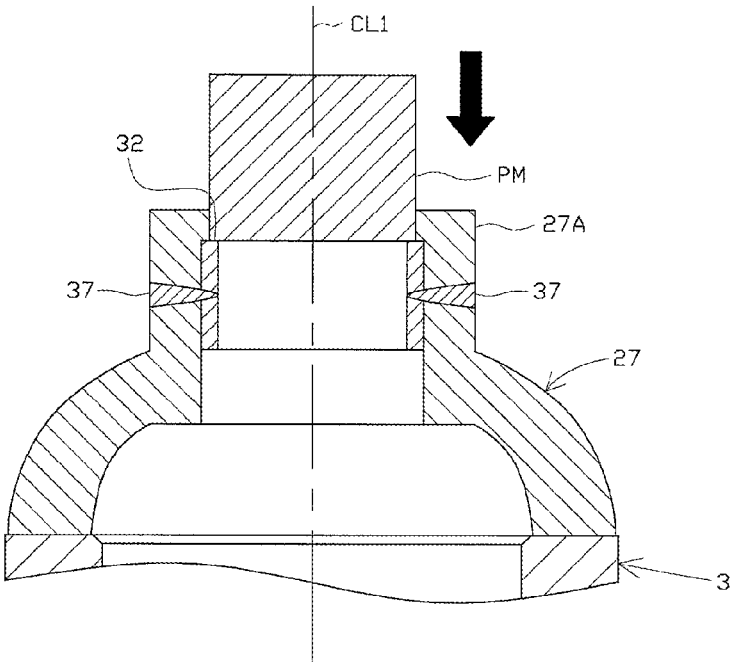
FIG. 9 is a sectional view used for explaining the procedure of a joint strength evaluation test.
Figure 11:
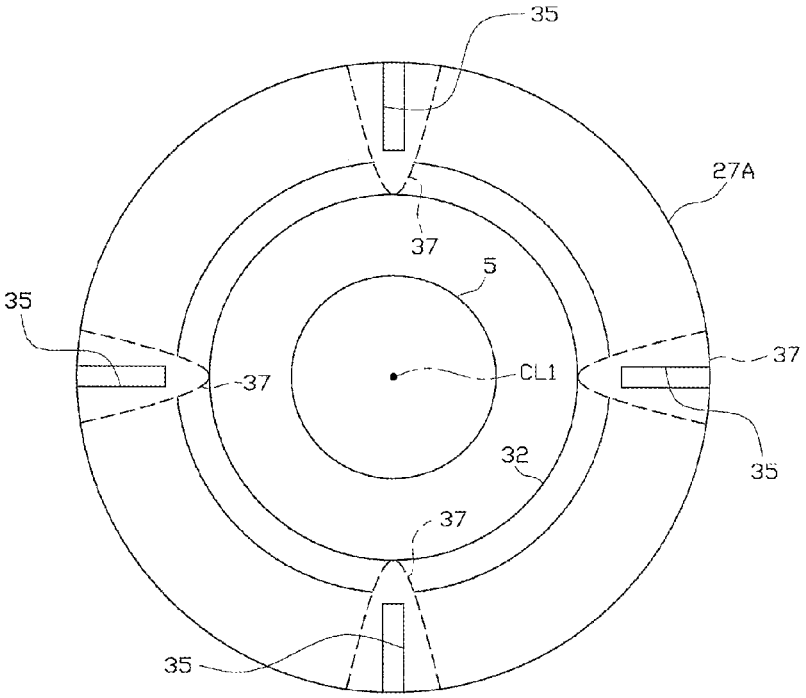
FIG. 11 is an enlarged schematic bottom view showing the configuration of Sample 5.
Figure 12:
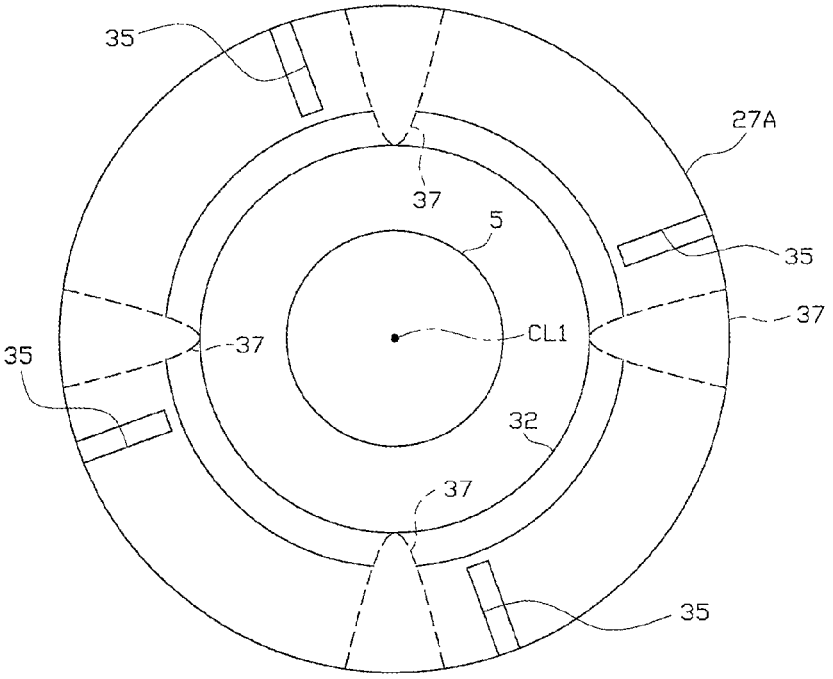
FIG. 12 is an enlarged schematic bottom view showing the configuration of Sample 6.

Next, in order to confirm the actions and effects achieved by the above-described embodiment, Sample 1 (comparative example) of a spark plug configured without providing recesses in the annular portion, and Samples 2 through 6 of a spark plug having recesses formed in the annular portion were manufactured, and a joint strength evaluation test was performed for each sample. The outline of the joint strength evaluation test is as follows. Namely, as shown in FIG. 9, the tip was pressed from the forward end side in the axial direction through use of a predetermined press machine PM, and a load (a breaking load at the time of being new) at which breakage or separation of the tip occurred was measured. Subsequently, a heating-cooling cycle of heating the tip to 800° C. and then cooling the tip was repeated 1,000 times. After that, the tip was pressed from the forward end side in the axial direction through use of the above-mentioned predetermined press machine PM, and a load (a breaking load after heating-cooling cycles) at which breakage or separation of the tip occurred was measured. Notably, it can be said that the smaller the decrease of the breaking load after heating-cooling cycles from the breaking load at the time of being new, the smaller the possibility that the joint strength decreases due to the load caused by the heating and cooling, and the greater the degree to which separation and cracking of the tip can be prevented reliably. Table 1 shows the results of the test.

penetrated the annular portion from the inner circumference to the outer circumference thereof (the same configuration as FIG. 7), the recesses were present over a portion of the tip presence range along the axial direction, and the tip was joined to the annular portion in the centrally located sub-region (the same configuration as FIG. 8). In Sample 5, the recesses were grooves, the recesses were present over a portion of the tip presence range (the same configuration as FIG. 6), and, as shown in FIG. 11, the tip was joined to the annular portion at the same positions as the recess formation positions along the circumferential direction of the annular portion (namely, regions other than the regions each located between adjacent recesses), and the tip was joined to the annular portion on the rear end side of the recesses in the axial direction. In Sample 6, the recesses were grooves, the recesses were present over a portion of the tip presence range (the same configuration as FIG. 6), and, as shown in FIG. 12, the tip was joined to the annular portion in a sub-region (other than the above-mentioned centrally located sub-region) of each region located between adjacent recesses.

Notably, the samples were the same in terms of the conditions for forming the welds.

TABLE 1

| | Sample 1 | Sample 2 | Sample 3 | Sample 4 | Sample 5 | Sample 6 |
|---|---|---|---|---|---|---|
| Presence/absence of recesses | Not provided | Provided | Provided | Provided | Provided | Provided |
| Recess presence range | — | Portion of tip presence range | Entirety of tip presence range | Portion of tip presence range | Portion of tip presence range | Portion of tip presence range |
| Shape of recesses | — | Grooves (non-penetrating shape) | Grooves (non-penetrating shape) | Penetrating shape | Grooves (non-penetrating shape) | Grooves (non-penetrating shape) |
| Positions of welds | — | Centers of inter-recess regions | Centers of inter-recess regions | Centers of inter-recess regions | Regions other than inter-recess regions | Non-center sub-regions of inter-recess regions |
| Breaking load at the time of being new (N) | 800 | 800 | 800 | 800 | 800 | 800 |
| Breaking load after heating-cooling cycles (N) | 50 | 500 | 600 | 700 | 300 | 400 |

Figure 10:
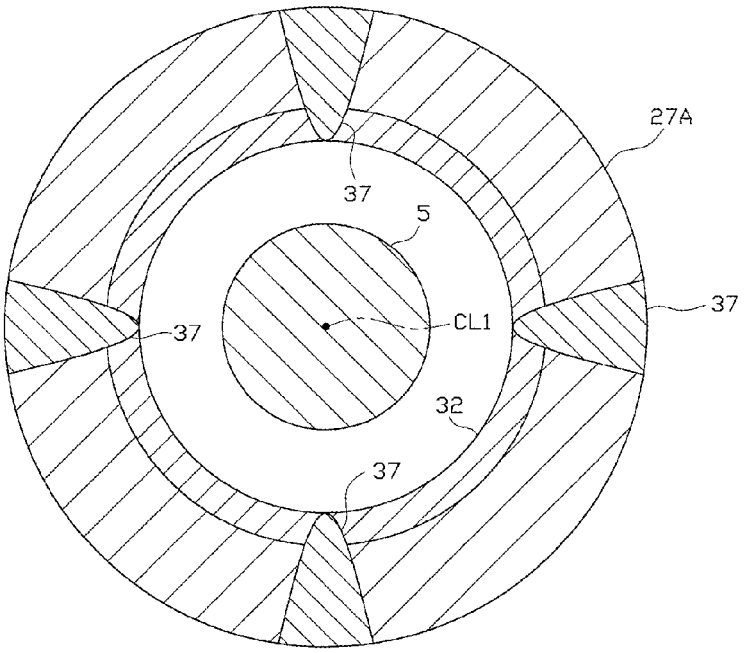
FIG. 10 is an enlarged schematic sectional view showing the configuration of Sample 1.

Notably, Samples 1 to 6 were configured as follows. Namely, as shown in FIG. 10, Sample 1 (Comparative Example) was configured such that no recess was provided in the annular portion, and the tip was joined to the annular portion through four welds provided at equal intervals along the circumferential direction. In Samples 2 through 6 (Examples), four recesses were provided at equal intervals along the circumferential direction of the annular portion. In Sample 2, the recesses were grooves (namely, the recesses were configured not to penetrate the annular portion from the inner circumference to the outer circumference thereof), the recesses were present over a portion of the tip presence range (the same configuration as FIG. 6), and the tip was joined to the annular portion in the center one of three sub-regions obtained by trisecting the region between adjacent recesses in the circumferential direction of the annular portion (the same configuration as FIG. 8). In Sample 3, the recesses were grooves, the recesses were present over the entirety of the tip presence range along the axial direction (the same configuration as FIG. 15), and the tip was joined to the annular portion in the centrally located sub-region (the same configuration as FIG. 8). In Sample 4, the recesses As shown in Table 1, it was found that, in the case of the sample (Sample 1) in which no recesses were provided, the breaking load after heating-cooling cycles is considerably small as compared with the breaking load at the time of being new, and the tip is likely to separate or crack in an environment in which heating and cooling are repeated. The conceivable reason for this is that the difference in stress occurring between the tip and the annular portion increased considerably.

In contrast, it was revealed that, in the case of the samples (Samples 2 through 6) in which recesses were provided in the annular portion, the decrease of the breaking load after heating-cooling cycles from the breaking load at the time of being new becomes sufficiently small, and separation and cracking of the tip can be restrained. The conceivable reason for this is that the difference in stress occurring between the tip and the annular portion decreased.

Also, as a result of comparison between samples (Samples 2 and 3) which differed only in the tip presence range along the axial direction, it was confirmed that the sample (Sample 3) configured such that the recesses are present over the entirety of the tip presence range along the axial direction has a better separation resistance. The conceivable reason for this is that the radial deformation of a portion of the annular portion where the tip was located on the inner circumference thereof was restrained effectively, and whereby the difference in stress occurring between the tip and the annular portion decreased further.

In addition, as a result of comparison between samples (Samples 2 and 4) which differed only in the point of whether or not the recesses penetrate the annular portion, it was found that, in the sample (Sample 4) configured such that the recesses penetrate the annular portion from the outer circumference to the inner circumference thereof, separation and cracking of the tip is more unlikely to occur. The conceivable reason for this is that, under high temperature, deformation of the annular portion in its radial and axial directions was restrained more effectively, whereby the difference in stress occurring between the tip and the annular portion decreased further.

Further, as a result of comparison between samples (Samples 2, 5, and 6) which differed only in the weld formation position, it was revealed that the samples (Samples 2 and 6) in which the tip was joined to the annular portion in the regions between adjacent recesses are more excellent in terms of separation resistance. The conceivable reason for this is that the tip was joined to a portion of the annular portion where its inner diameter is particularly less likely to increase under high temperature, whereby the difference in stress occurring between the tip and the annular portion decreased further.

Moreover, it was found that the sample (Sample 2) in which the tip was joined to the annular portion in the centrally located sub-region of the region between adjacent recesses has an extremely good separation resistance. The conceivable reason for this is that a portion of the annular portion located at the center of the region between the recesses is very small in terms of the amount of increase in the inner diameter under high temperature, and since the tip was joined to that portion, the difference in stress occurring between the tip and the annular portion became considerably small.

In view of the results of the above-described test, it is preferred that recesses be provided in the annular portion in order to effectively restrain separation and cracking of the tip in an environment in which heating and cooling are repeated.

Also, from the viewpoint of further enhancing the separation resistance, it is more preferred that the recesses be provided over the entirety of the tip presence range along the axial direction, and/or the recesses be configured to penetrate the annular portion from the outer circumference to the inner circumference thereof.

Moreover, in order to further enhance the separation resistance, it is more preferred that the tip be joined to the annular portion in the region located between adjacent recesses, and it is even more preferred that the tip be joined to the annular portion in the centrally located sub-region of the region located between adjacent recesses.

Notably, the present invention is not limited to the description of the above-described embodiment, and may be practiced as follows. Needless to say, other application examples and modifications which are not exemplified below are also possible.

Figure 13:
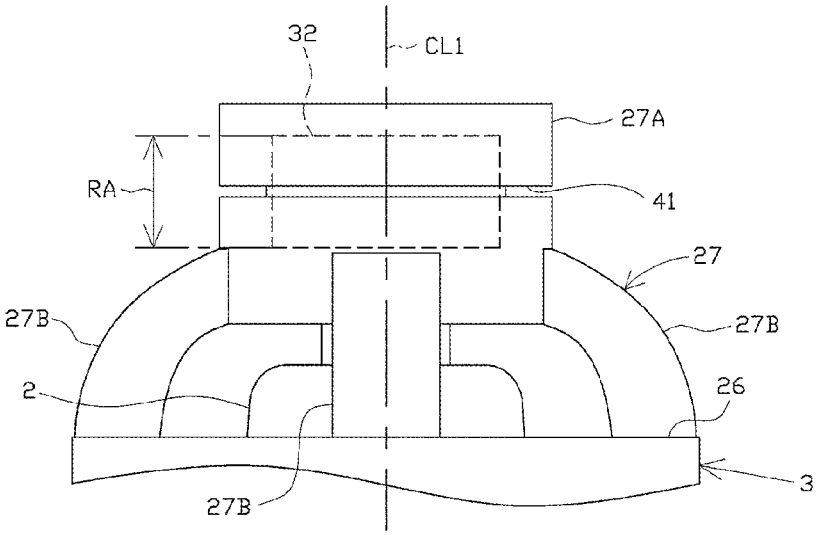
FIG. 13 is an enlarged front view showing the configuration of a recess in another embodiment.
Figure 14:
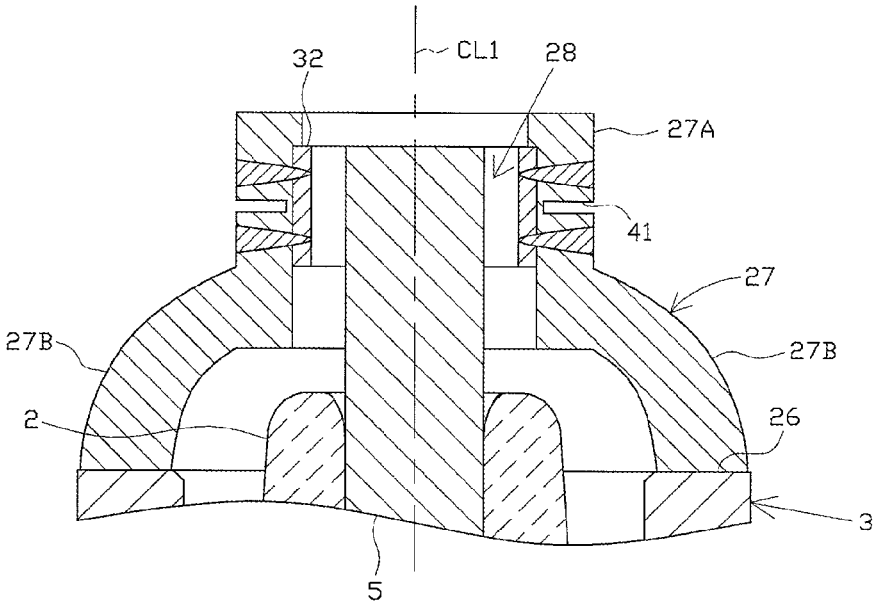
FIG. 14 is an enlarged sectional view showing the configuration of a recess in another embodiment.

(a) In the above-described embodiment, the recesses 35 are configured to extend in a direction intersecting with the circumferential direction of the annular portion 27A (the direction of the axial line CL1). However, as shown in FIGS. 13 and 14, there may be provided recesses 41 configured to extend in the circumferential direction of the annular portion 27A in the range RA where the tip 32 is present. Notably, in this case, it is preferred that the tip 32 be joined to the annular portion 27A at positions separated from the recesses 41. Namely, since the annular portion 27A is configured to thermally expand toward the recess 41 under high temperature, portions of the annular portion 27A located near the recess 41 deform relatively greatly under high temperature. Accordingly, by joining the annular portion 27A and the tip 32 at positions determined to avoid the portions which deform relatively greatly, the difference in stress occurring between the annular portion 27A and the tip 32 can be decreased more reliably. As a result, cracking or separation of the tip 32 can be prevented more reliably.

Figure 15:
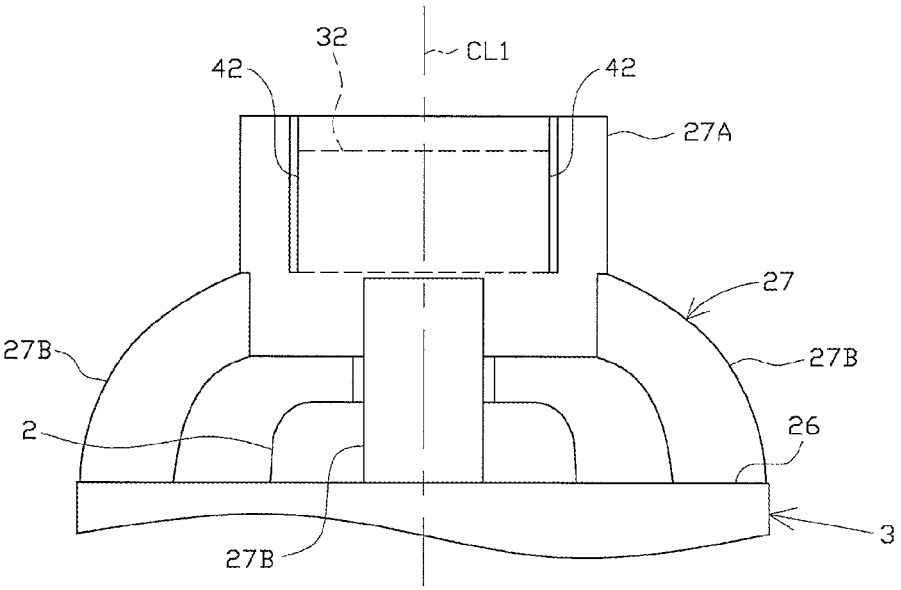
FIG. 15 is an enlarged front view showing the configuration of recesses in another embodiment.
Figure 16:
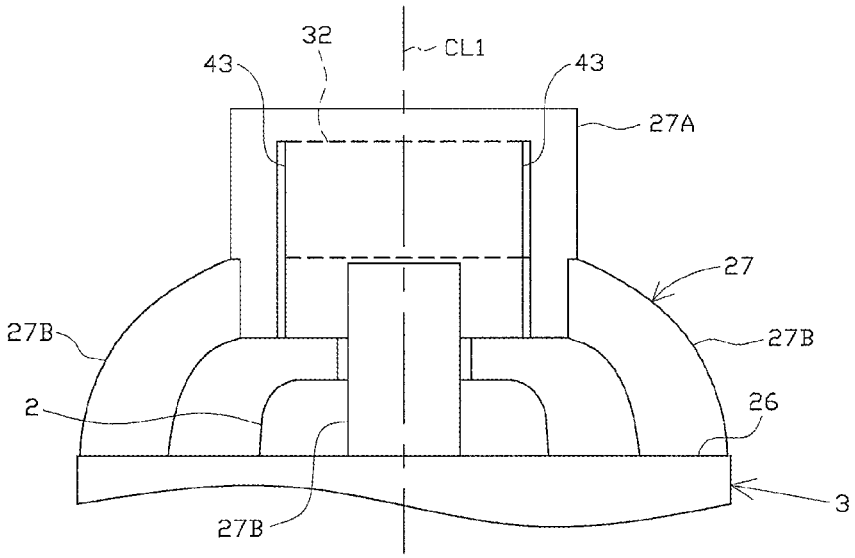
FIG. 16 is an enlarged front view showing the configuration of recesses in another embodiment.

In addition, although, in the above-described embodiment, the recesses 35 are configured to penetrate the annular portion 27A from the rear end surface to the forward end surface thereof, the recesses are not necessarily required to penetrate the annular portion 27A from the rear end surface to the forward end surface thereof. For example, as shown in FIG. 15, there may be provided recesses 42 configured to extend from the forward end surface of the annular portion 27A to the rear end of the tip 32. Also, as shown in FIG. 16, there may be provided recesses 43 configured to extend from the rear end surface of the annular portion 27A to the forward end of the tip 32.

Figure 17:
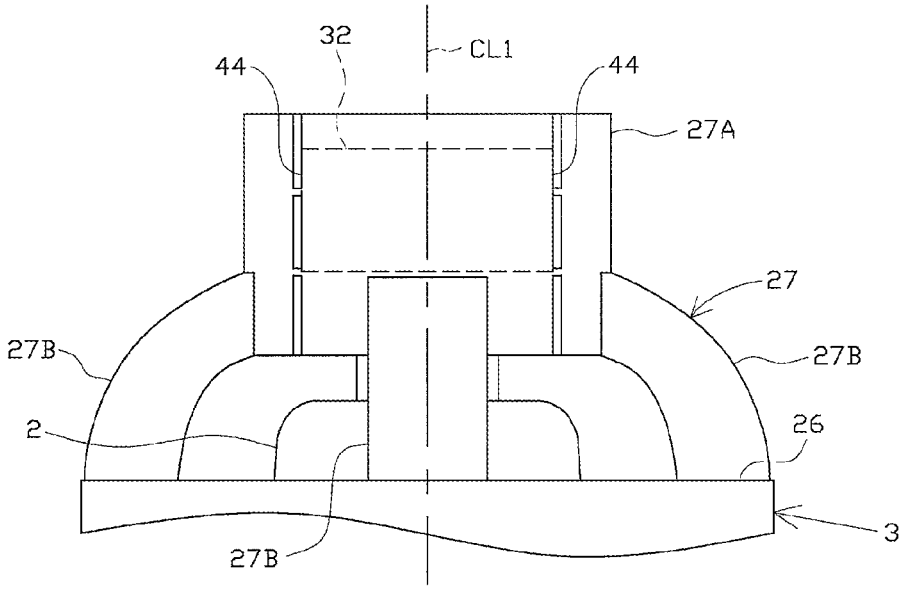
FIG. 17 is an enlarged front view showing the configuration of recesses in another embodiment.
Figure 18:
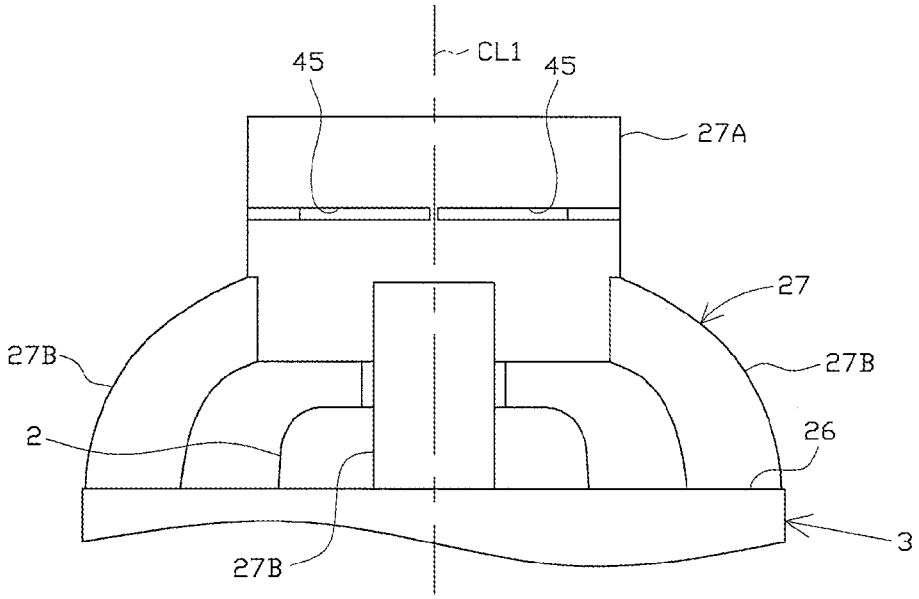
FIG. 18 is an enlarged front view showing the configuration of recesses in another embodiment.

In addition, the recesses are not necessarily required to extend continuously. For example, as shown in FIGS. 17 and 18, there may be provided recesses 44 or 45 which extend intermittently.

Figure 19:
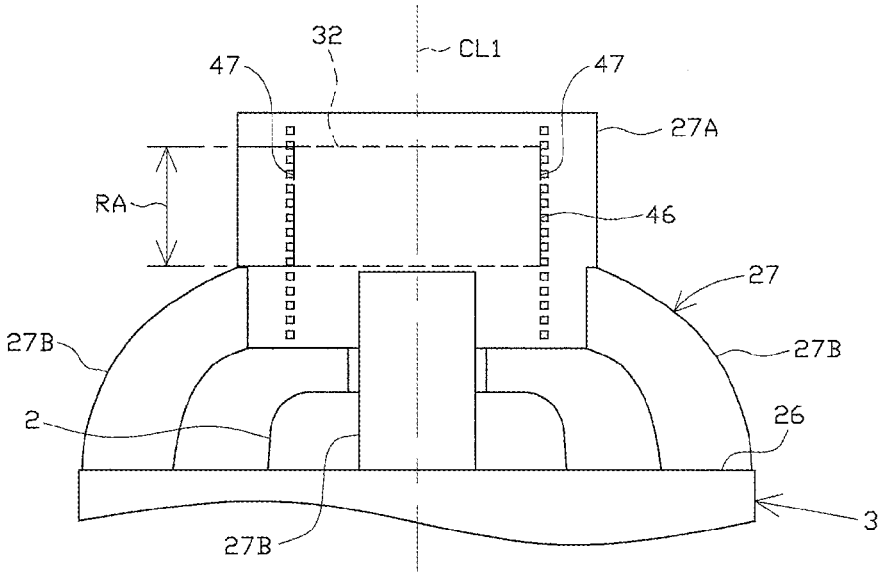
FIG. 19 is an enlarged front view showing the configuration of recesses in another embodiment.

Also, the recesses are not necessarily required to extend in the circumferential direction of the annular portion 27A, the direction of the axial line CL1, or other directions. As shown in FIG. 19, there may be provided recesses 47 which are dot-shaped pits.

Figure 20:
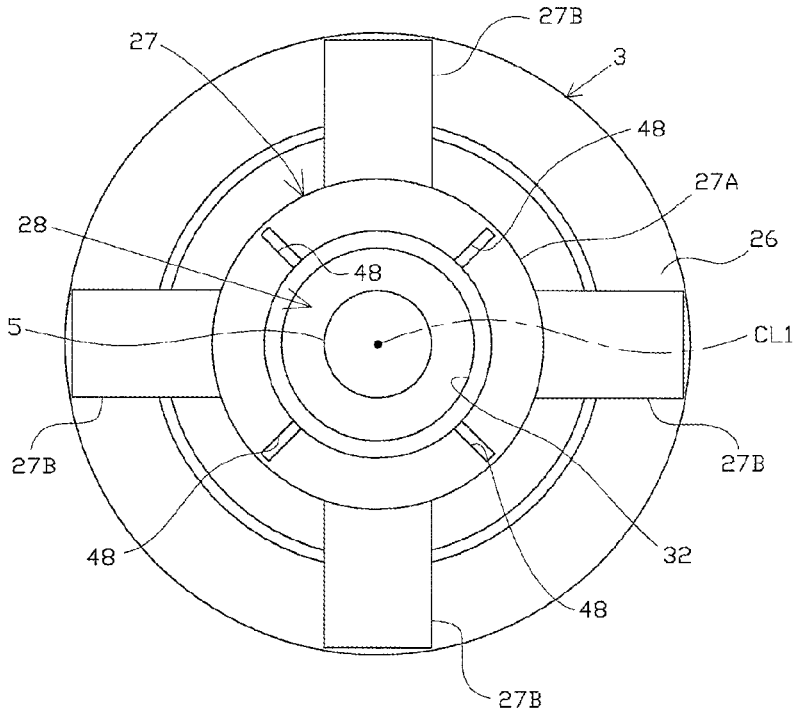
FIG. 20 is an enlarged bottom view showing the configuration of recesses in another embodiment.
Figure 21:
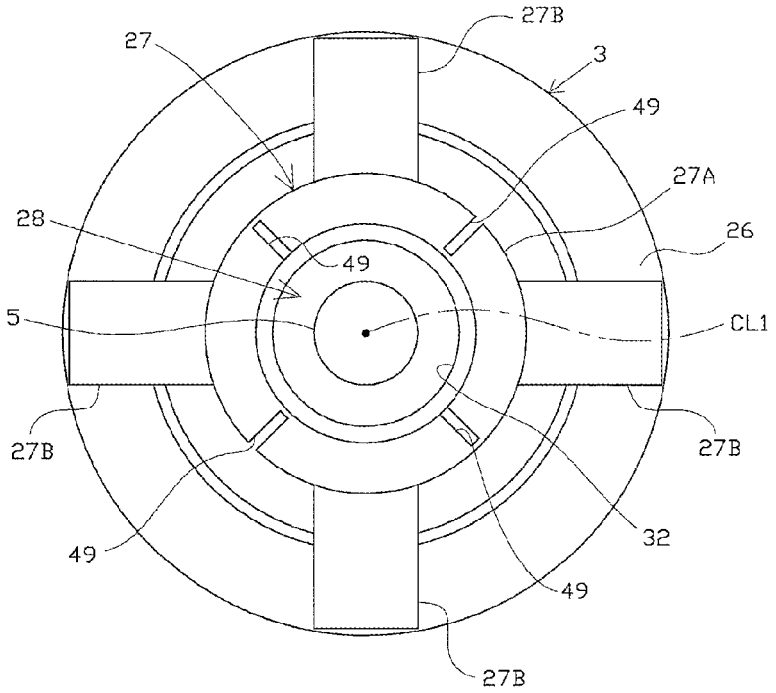
FIG. 21 is an enlarged bottom view showing the configuration of recesses in another embodiment.

In addition, as shown in FIG. 20, recesses 48 may be provided on the inner circumference of the annular portion 27A. Alternatively, as shown in FIG. 21, recesses 49 may be provided on both of the inner and outer circumferences of the annular portion 27A.

Figure 22:
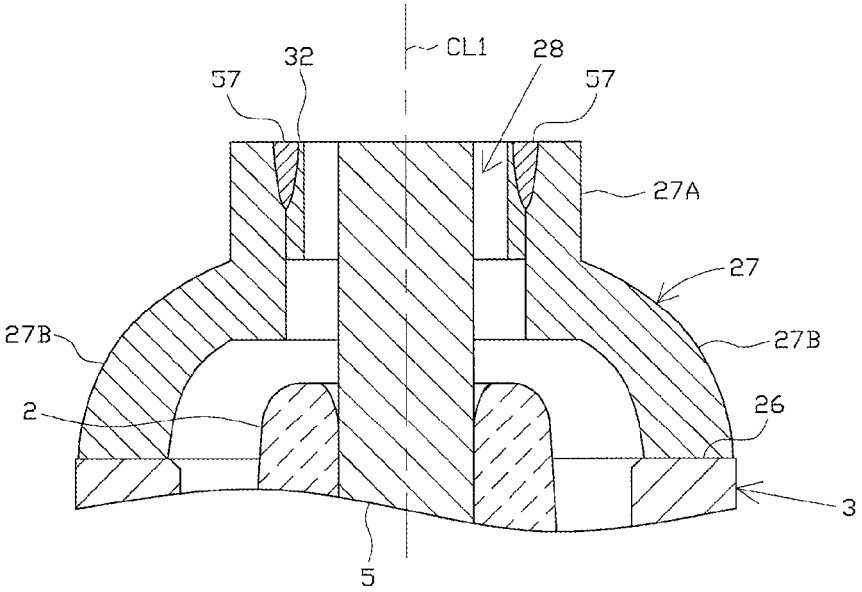
FIG. 22 is an enlarged sectional view showing the configuration of welds in another embodiment.

(b) In the above-described embodiment, the welds 37 are formed by applying a laser beam or the like from the outer circumference of the annular portion 27A toward the inner circumference thereof, and the tip 32 is joined to the annular portion 27A through the welds 37. However, the manner of joining the tip 32 to the annular portion 27A is not limited thereto. For example, as shown in FIG. 22, welds 57 may be formed by applying a laser beam or the like from the forward end side (in the direction of the axial line CL1) toward the boundary between the inner circumference of the annular portion 27A and the outer circumference of the tip 32, and the tip 32 may be joined to the annular portion 27A through the welds 57. Also, the tip 32 may be joined to the annular portion 27A by means of brazing.

Figure 23:
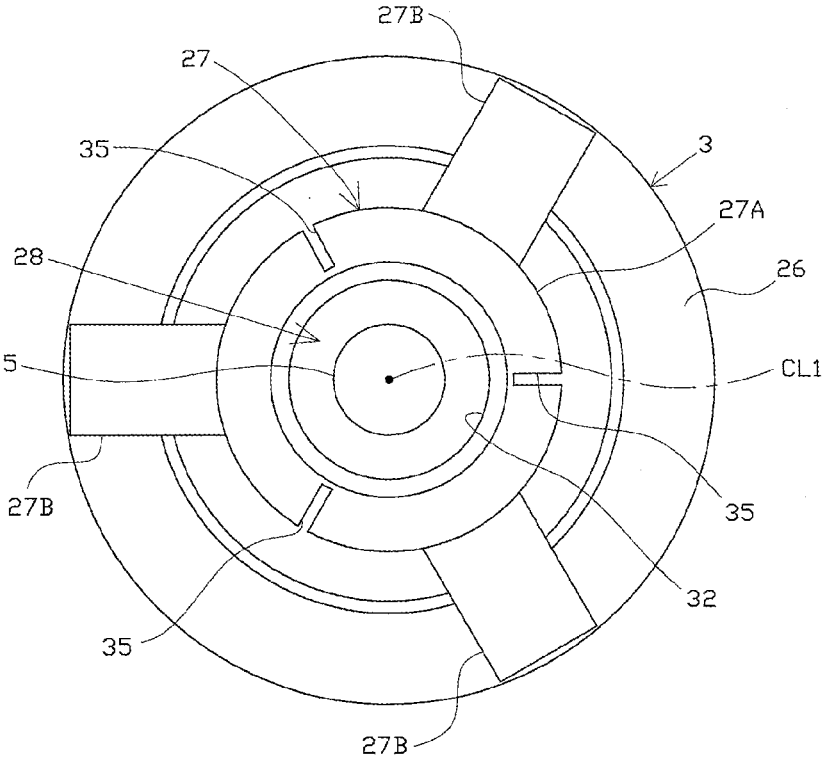
FIG. 23 is an enlarged bottom view showing the configuration of a leg portion in another embodiment.
Figure 24A:
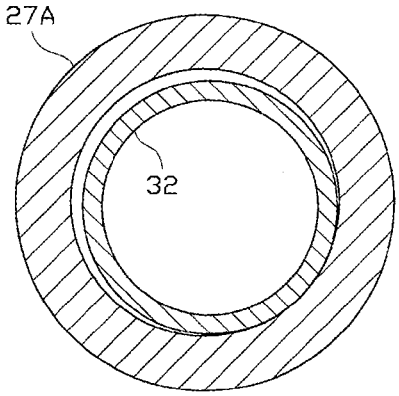
FIG. 24A is a schematic sectional view showing separation of a tip.
Figure 24B:
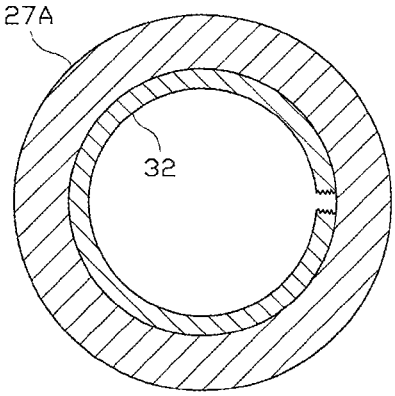
FIG. 24B is a schematic sectional view showing cracking of a tip.

(c) In the above-described embodiment, the number of the leg portions 27B is four. However, the number of the leg portions is not limited thereto. For example, as shown in FIG. 23, three leg portions 27B may be provided.

(d) The number of the welds, etc. in the above-described embodiment are mere examples, and the number of the welds, etc. may be changed freely.

(e) In the above-described embodiment, the ground electrode 27 is joined to the forward end portion 26 of the metallic shell 3. However, the present invention is applicable to the case where a portion of a metallic shell (or, a portion of an end metal piece welded beforehand to the metallic shell) is formed into a ground electrode by machining (refer to, for example, Japanese Patent Application Laid-Open (kokai) No. 2006-236906).

(f) In the above-described embodiment, the tool engagement portion 19 has a hexagonal cross section. However, the shape of the tool engagement portion 19 is not limited thereto. For example, the tool engagement portion 19 may have a Bi-HEX (modified dodecagonal) shape [ISO22977:2005(E)] or the like.

DESCRIPTION OF REFERENCE NUMERALS

1: spark plug
2: ceramic insulator (insulator)
3: metallic shell
4: axial hole
5: center electrode
27: ground electrode
27A: annular portion
28: spark discharge gap (gap)
32: tip
35: recess
CL1: axial line

The invention claimed is:

1. A spark plug comprising:

a tubular insulator having an axial hole extending therethrough in the direction of an axial line;

a center electrode inserted into a forward end portion of the axial hole;

a tubular metallic shell provided around the insulator;

a ground electrode whose base end portion is fixed to the metallic shell and which has an annular portion formed at a forward end portion thereof, the center electrode being disposed radially inward of the annular portion, the ground electrode having a plurality of leg portions provided on the outer circumference of a rear end portion of the annular portion in a circumferential direction and extended toward the rear end side; and an annular tip which is joined to an inner circumference of the annular portion and which forms a gap between the center electrode and an inner circumferential surface of the annular tip, wherein a recess is provided on at least one of the inner circumference and an outer circumference of the annular portion, the annular portion having an outer diameter greater than a width of the leg portion.

2. A spark plug according to claim 1, wherein the recess extends at least from a forward end surface of the annular portion to a rear end of the tip, or at least from a rear end surface of the annular portion to a forward end of the tip.

3. A spark plug according to claim 1, wherein the recess penetrates the annular portion from the inner circumference to the outer circumference thereof.

4. A spark plug according to claim 1, wherein a plurality of the recesses are provided intermittently along a circumferential direction of the annular portion, and the tip is joined to the annular portion in a region between adjacent recesses.

5. A spark plug according to claim 4, wherein the tip is joined to the annular portion in a centrally located subregion among three sub-regions obtained by equally trisecting the region between the adjacent recesses along the circumferential direction.

6. A spark plug according to claim 2, wherein the recess penetrates the annular portion from the inner circumference to the outer circumference thereof.

* * * * *